United States Patent [19]

Roberts et al.

[11] Patent Number: 4,917,240

[45] Date of Patent: Apr. 17, 1990

[54] EXPANDABLE FLORAL GREETING CARD

[75] Inventors: Therese L. Roberts; Eddie D. Adams, both of Denver, Colo.

[73] Assignee: Michael C. Huseby, Denver, Colo.

[21] Appl. No.: 294,656

[22] Filed: Jan. 9, 1989

[51] Int. Cl.[4] ..... B65D 5/36

[52] U.S. Cl. ..... 206/232; 40/124.1; 47/41.12; 206/423; 229/117.01

[58] Field of Search ..... 40/312, 313, 124.1, 40/539, 584; 206/232, 423, 459; 47/41 R, 41.1, 41.2, 41.11, 41.12, 41.13, 84; 229/103, 108, 111, 41 R, 41 B

[56] References Cited

U.S. PATENT DOCUMENTS

| | | | |
|---|---|---|---|
| 342,675 | 5/1886 | Braddock | 47/41 |
| 1,502,248 | 7/1924 | Hawley | 40/312 |
| 1,518,207 | 12/1924 | McCauley | 47/41 |
| 1,887,139 | 11/1932 | Richardson | 47/41.12 |
| 2,292,653 | 8/1942 | Palmer | 229/108 |
| 2,344,437 | 3/1944 | Lande | 206/232 |
| 2,970,740 | 2/1961 | Fowle et al. | 229/117 |
| 3,144,932 | 8/1964 | Zerbo, Jr. | 206/423 |
| 3,407,969 | 10/1968 | Klein et al. | 229/111 |
| 3,451,612 | 6/1919 | Sinoto | 229/111 |
| 4,584,213 | 4/1986 | Rentowl | 47/41.12 |

FOREIGN PATENT DOCUMENTS

| | | | |
|---|---|---|---|
| 2583716 | 12/1986 | France | 229/41 B |

*Primary Examiner*—Jimmy G. Foster
*Attorney, Agent, or Firm*—James E. Pittenger

[57] ABSTRACT

A floral greeting card is provided which includes two sections. A partially assembled receptacle base is provided which can be easily expanded into a rigid hollow receptacle base having a slanted or angled front face. Bottom flaps form an interlocking panel when the receptacle blank is expanded. The inside surface of the bottom portion of the receptacle is coated with a water-resistant material and a block of treated foam material is inserted in the bottom of the receptacle for holding the stems of a floral arrangement and providing nutrients to retain the freshness of the flowers. A face card having a central aperture and various designs and greetings can be attached to the tapered face of the receptacle to provide a pleasing presentation. The flowers are positioned through the opening in the face card and retained in the foam block. The face card can cover both the front and rear surfaces of the receptacle base and carry a design and greeting on one or both sides. The receptacle base can also be laid on its back surface with the face card reversed for outdoor ceremonies or decoration.

21 Claims, 3 Drawing Sheets

100
112
110
114
60
122
120
30
61
32
132
140
151
147
136
159
22
182
106
180
162
104
130
150
138
18
52
50
172
148
146
142
152
144
145
154
134
157
26
34
28
38
54
56
170
102
160
164
24
158
156
163
202
206
F
240
244
242
204
14

EXPANDABLE FLORAL GREETING CARD

FIELD OF THE INVENTION:

This invention is directed to an expandable receptacle which can be utilized for presenting decorative arrangements. It is more specifically directed to a floral type greeting card which includes an expandable base and a face card attached to the base for displaying a decorative greeting or statement and a floral arrangement.

BACKGROUND OF THE INVENTION:

Greeting cards have been well known for many, many years. These cards have taken on many different shapes and sizes in order to fit any and all occasions. At the same time, it is common practice for special occasions, to send potted or cut flowers to an individual or group of people for celebrating specific events or accomplishments or to cheer up sick or convalescing people.

While various greeting cards take on different shapes and sizes, it has been impractical up to now to combine a beautiful floral arrangement along with a special greeting card. This is not to say, that it has not been attempted, but this combination of elements in the past has been quite unsatisfactory. On some occasions, a vial containing water has been positioned on the reverse side of the greeting card with an opening provided through the card for the insertion of a small flower or bud. The stem of the flower extends downward into the partially sealed tube so that the bud will remain alive and have an acceptable appearance for a few days at least until the card can be delivered.

On some occasions, a hole has merely been punched through the card and flowers have been inserted through the folder and fastened on the reverse side to retain the flowers in position. No attempt was provided in these cards to preserve the freshness or appearance of the flowers themselves. With this type of card, it is obvious that it is necessary to deliver the card immediately once the floral arrangement has been inserted since the flowers cannot be expected to look fresh or live for very long.

Various other combinations have been attempted in the past, but also with only minor success. One of these took the form of a Christmas ornament which was provided in a fold-up three-dimensional box wherein the blank for the box was presented to the user with instructions for folding and inserting various tabs to secure the box in its three-dimensional configuration. The purpose of this box was for germinating seeds after the Christmas season and the box was no longer used as an ornament on the Christmas tree.

Other types of expandable cartons have been well known in the prior art over the years. These are containers which are sold in a flat configuration, but which can be expanded to form a box-like structure. In the past, these cartons have been used for many purposes, but none have ever been used as a base for a greeting card and more especially a floral-type greeting card.

As a result, the present invention is directed to an arrangement for providing an expandable floral greeting card which can be used for various occasions and which can be easily stored in the inventory of a small shop or florist.

It is an object of the present invention to provide an inexpensive and easily used product which can be quickly assembled into a proper shape with the attachment or insertion of a floral decorative arrangement. A foam block is provided for securing the flowers as well as providing nutrients and fluids to maintain the freshness of the flowers over a period of time.

INFORMATION DISCLOSURE STATEMENT:

The following statement is provided in order to comply with the applicants' acknowledged duty to inform the Patent Office of any pertinent information of which they are aware. The following information refers to the most pertinent patents of which the applicants have knowledge with respect to the subject matter of the present invention. Although other patents may be available which deal with the subject matter, they are believed to be less pertinent than the patents which are discussed herein.

The Schumm patent (U.S. No. 508,149) discloses a flower inclusive greeting card which includes a metallic gripping device for attaching a flower to the face of the card.

The Mittleburg patent (U.S. No. 1,522,201) discloses a receptacle which can have various decorations applied to the outside. This patent also shows various types of decorations which can be applied to the receptacle for different occasions.

The Whittington patent (U.S. No. 1,885,879) discloses a greeting card which includes a liquid-filled vial on the back side of the card. An opening is provided in the face of the card so that a fresh flower can be inserted through the opening and the stem placed within the vial where it is retained in a moist atmosphere.

The Pfeiffer patent (U.S. No. 2,217,454) discloses a relatively flat greeting card which has flowers attached to the front surface with the stems passing through and attached to the back surface of the card.

The Bacigalupi patent (U.S. No. 2,358,295) shows a carton blank which provides a tray for holding flowers during shipment. The tray is folded into a three-dimensional configuration from the blank which in turn, is positioned within a box.

The Austin patent (U.S. No. 4,344,537) discloses a carton blank which is assembled as a collapsed carton container. For use, the container is expanded and the desired contents placed inside. This container is primarily intended for commercial fast food use.

The Mastriano patent (U.S. No. 4,418,497) shows a card that can be assembled upon receipt and includes a seed germination packet. The germination packet is placed in the bottom of the card for the purpose of germinating and growing a plant.

The Rentowl patent (U.S. No. 4,584,213) also shows a greeting card which is formed from water impervious material and is provided with an arrangement for mounting at least one fresh or artificial flower thereon. A receptacle is provided on the back side of the card which contains a foam plastic material which will retain water. A transparent or translucent cover is also disclosed for covering the flower so as to preserve and protect the flower by preventing it from drying out. The card is made from a water impervious material so that the moisture in the receptacle will not damage the card and so that the card can be placed outdoors and not be affected by the weather and environment.

SUMMARY OF THE INVENTION:

The applicants' invention provides a partially assembled expandable container or base which forms a receptacle having a sloping front surface. The bottom portion of the interior of the base is coated to make it water impervious or resistant and a block of treated foam material is inserted into the base for the retention of the stems of cut flowers. A floral preservative liquid is absorbed in the foam material to retain the freshness of the flowers for a number of days. A face card can be attached to the sloping face of the receptacle and have any one of a number of preprinted greetings and decorative designs provided thereon. Various sizes of openings are provided in the face card for the insertion of a flower arrangement. The combination of the flower arrangement and the decorative design on the face card provides a very pleasing appearance to the recipient. Throughout this application even though reference is made to floral arrangements, it is also possible to provide dry flowers or other decorative arrangements, if desired.

Various folding techniques are provided so that the partially assembled base can be easily expanded into a three-dimensional receptacle from the flat blank. In this way, the blanks and a number of different greeting face cards can be provided and quickly assembled for the required occasion. The face cards can be attached to the sloping face of the base by means of adhesive strips, Velcro, glue or any other satisfactory quick attaching method. At the same time, it is possible to allow the base to be positioned on its back panel with the flowers sticking outwardly from the face card for use in the outdoors, such as at cemeteries. If desired, a folded face plate can be provided to cover both the front and back of the receptacle and to provide greetings, statements or designs on both the front and back surface.

While the invention has been briefly described herein, it is to be understood that this invention is not to be limited to the exact features or description which is provided herein, but is intended to cover any similar arrangements which this disclosure may encompass.

Figure 1:
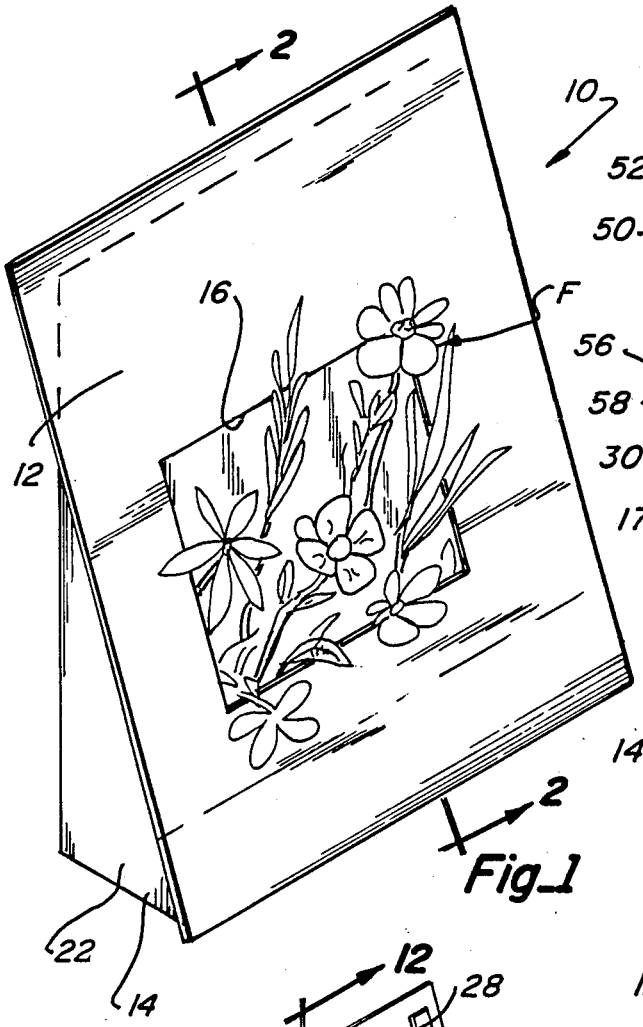
FIG. 1 shows a perspective view of the assembled floral greeting card according to the present invention.
Figure 2:
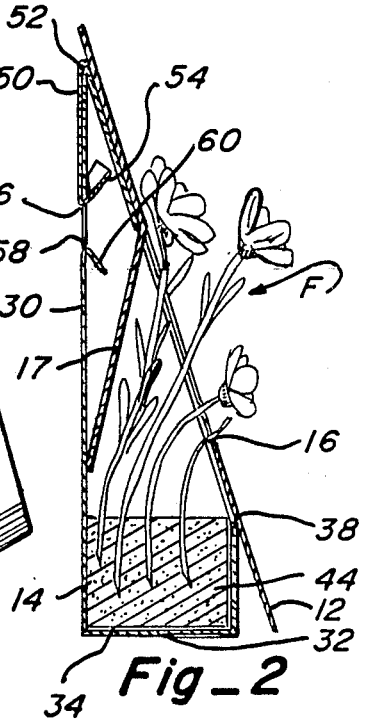
FIG. 2 is a side sectional view taken along the lines 2—2 of FIG. 1.
Figure 3:
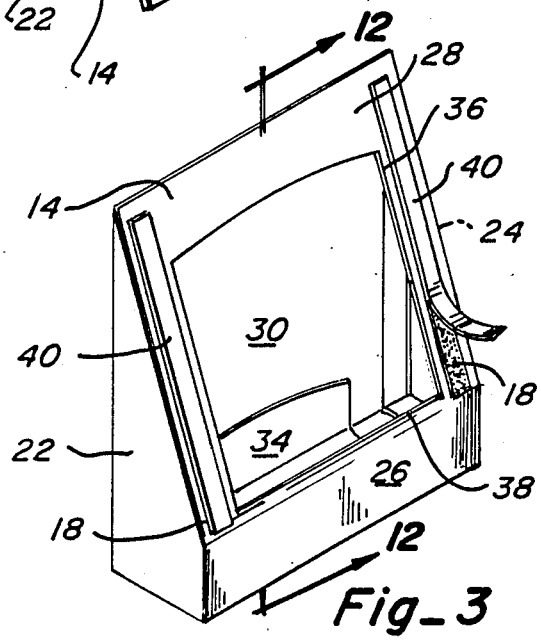
FIG. 3 is a pictorial perspective view showing the base receptacle assembled.
Figure 4:
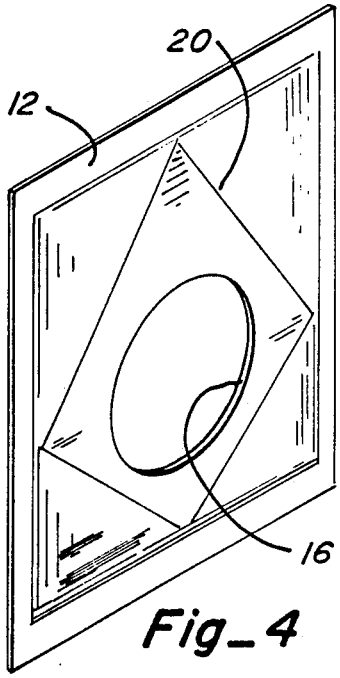
FIG. 4 is a perspective pictorial view of the face card having a fairly large central opening.

DETAILED DESCRIPTION OF THE INVENTION:

FIG. 1 shows a floral greeting card 10 having a face card 12 and partially assembled expandable receptacle or base 14. Cut flowers F are arranged to extend outwardly through central opening 16 provided in the face card 12. It is to be understood that cut flowers or any other suitable decorations can be used with the present invention to provide a pleasing designer effect.

The face card 12 is secured to the expandable base 14 by means of adhesive strips 18. As will be explained later, it is possible that the face card or plate 12 and adhesive strips 18 can be provided for covering only the front portion of the base 14 as well as being arranged to extend across the front and back of the base, if desired. The face card 12 can be of any size, but usually the width and height dimensions are slightly larger than the base 14 in order to cover and shield the view of the base from the front area. Also, it is possible to have any kind of design 20 imprinted on the face card to suit the particular occasion for which the card will be used. This design could include writings, photographs, artistic renditions, and/or designs using one or many colors. The opening 16 can be centrally located or positioned off-center and be of any size desirable to allow the positioning of cut flowers or other materials which are used for additional design presentation. In addition, it is possible that the face card 12 can be fabricated from various materials such as paper, plastic or even metal and can be flat or folded into three-dimensional shapes, if desired. For the purpose of the face card, it is to be recognized that any type of card can be utilized as part of the present invention which will provide the desired appearance and pleasing effect.

The expandable base is formed in the shape of a hollow receptacle having the shape of a box with side panels 22, 24, front panel 26, having a receding or angularly tapered portion 28, back panel 30 and bottom panel 32.

Although for illustration purposes, the front panel 26 is shown having a tapered portion 28 angled backward toward the upper portion of the back panel 30, it is to be understood that this panel can end in a flat top portion which is the same dimension as the bottom panel 32. It is highly desirable, however, to have the front portion 28 slanted which lends itself to holding the face card 12 in a more visible angled position. A foldable flap 34 is formed as a cutout in the front panel 26 which forms an opening 36 in the front panel 26. The flap 34 incorporates a fold line 38 formed between the vertical portion of the front panel 26 and the flap 34. The flap 34 is bent backward and folded so as to fit flush against the inside surface of the front panel 26, the bottom panel 32 and back panel 30. This arrangement provides additional reinforcement in the lower areas of the receptacle base 14.

The adhesive strips 18 are positioned along the sides of the opening 36 on the sloping portion 28 of the front panel 26. A protective cover strip 40 can be positioned over the surface of the adhesive strips 18 to protect the adhesive until it is time to position and install a face card 12. In most cases, the face card 12 remains flat and the adhesive strips 18 will extend only to the end of the sloping surface 28 and not down across the vertical front panel surface 26. In this way, the face card can be positioned so that the bottom edge will be even with the surface supporting the base 14.

The bottom interior area of the base 14 at least up to the fold line 38 on the front surface 26 can be coated with a moisture resistant material such as a suitable clay or plastic material. In this way, moisture will be prevented from soaking into the paper board material which is used to fabricate the base 14 and allow it to retain its rigidity and strength.

An open cell foam material 44 which is commonly used for floral arrangements, can be cut to fit the lower interior portion of the base 14. A suitable floral foam material marketed by Smithers - Oasis Company of Kent, Ohio under the trademark "OASIS" has been found to be quite suitable for this purpose.

The foam material is usually soaked in a flower preservative liquid until it is essentially saturated. To retain this fluid within the material, the block is then wrapped in a thin polyethylene sheet having approximately a one mil thickness and heat sealed. In this way, the floral preservative is retained within the block and is prevented from evaporating or leaking. At the time that the wrapped foam material is used, it is placed in the bottom portion of the base and the stems of the flowers are pushed through the polyethylene wrapping and forced into the block. If the stems are not strong enough to perform this task, a small pointed tool can be used to make the holes necessary for the positioning of the stems of the flowers. In this way, a number of flowers and stems can be inserted and secured in the block to provide a floral arrangement which will be arranged through the opening 16 in the face card 12.

Although the present invention is described as utilizing the plastic foam block for holding and retaining the floral arrangement, it is to be understood that any other material can be substituted for the block such as a poured foam plastic or other granular material which can be poured into the receptacle. Although these materials are less desirable than the saturated foam block, they will still accomplish the desired result.

As will be explained later, the receptacle base 14 can be formed from a die-cut paper board blank which can be partially assembled and then expanded when desired for utilizing the floral greeting card. When a foldable blank is used, the front slanted portion 28 of the front panel 26, can have an extension flap section 50 which is bent at a fold line 52 and folded downwardly across the back panel 30. The folded extension flap 50 can have a tab portion 54 at its outer end which can be bent along fold line 56 through a slotted opening 58 formed by a cutout 60 horizontally formed along the upper portion of the back panel 30. In this way, the slanted front portion 28 can be interlocked along the top edge of the back panel 30 with the slotted opening 58 forming a convenient hand grip for holding the receptacle base 14 and thus, the entire floral card 10.

Figure 5:
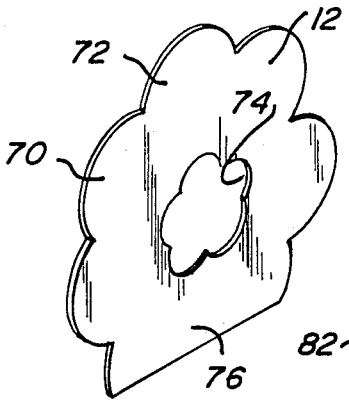
FIGS. 5–7 are perspective views showing three different designs for face cards.
Figure 6:
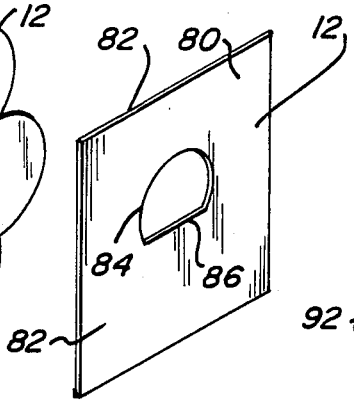
Figure 7:
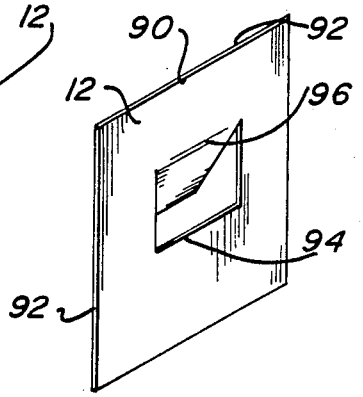
Figure 8:
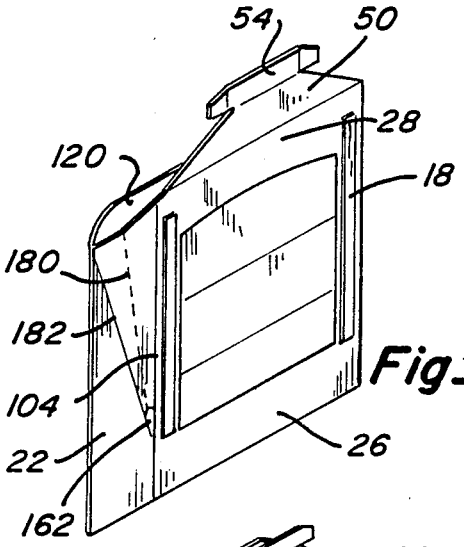
FIG. 8 shows a front perspective view of the flat receptacle blank.
Figure 9:
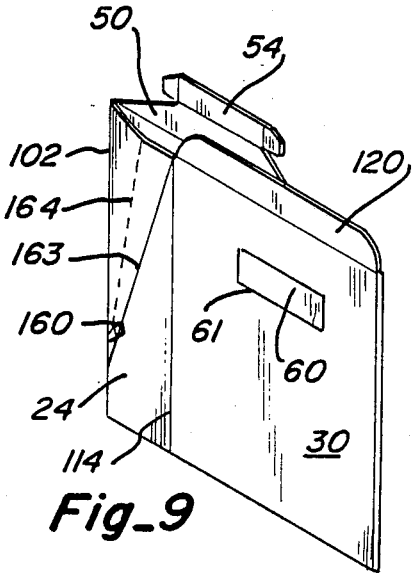
FIG. 9 shows the rear perspective view of the flat receptacle blank.
Figure 10:
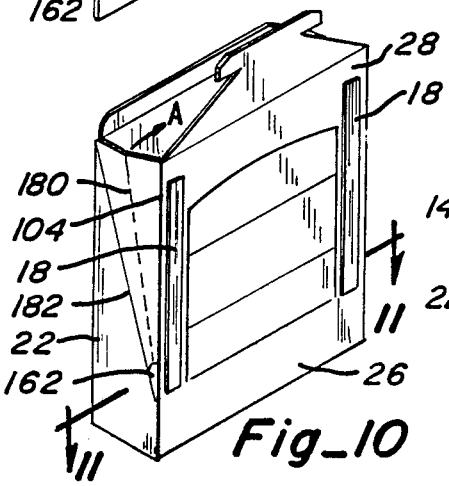
FIG. 10 shows a partially assembled and expanded receptacle.
Figure 11:
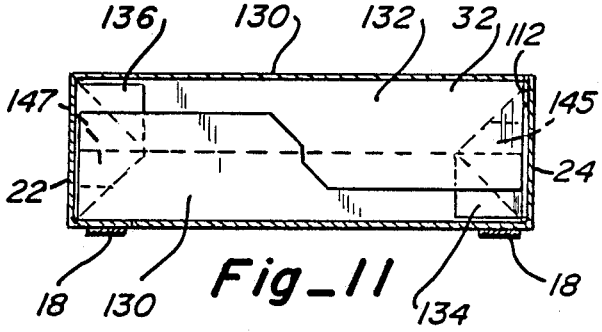
FIG. 11 is a partial sectional view of the inside bottom end of the receptacle taken along lines 11—11 of FIG. 10.

FIGS. 5–7 show various configurations that are possible for the face card 12. The first face card 70 has scalloped outer edges 72 and a scalloped central opening 74. The bottom edge can be a generally flat line so as to rest upon the support surface for the floral card. The second face card 80 has a generally square or rectangular outer configuration formed by generally straight edges 82 and includes a truncated circular central opening 84. With the central opening arrangement 84, it is possible that the opening can be die-cut in the face card 80 and folded inwardly into the inner portion of the base along fold line 86 or it can be cut out completely. The third face card 90 essentially also is formed in a square or rectangular configuration having straight sides 92 and a generally rectangular central opening 94. The portion which is die-cut to form the opening 94 is folded backward along fold line 96 to allow this portion to act as a guide for directing the flower stems into the base 14.

Figures 12, 13, 14, 15:
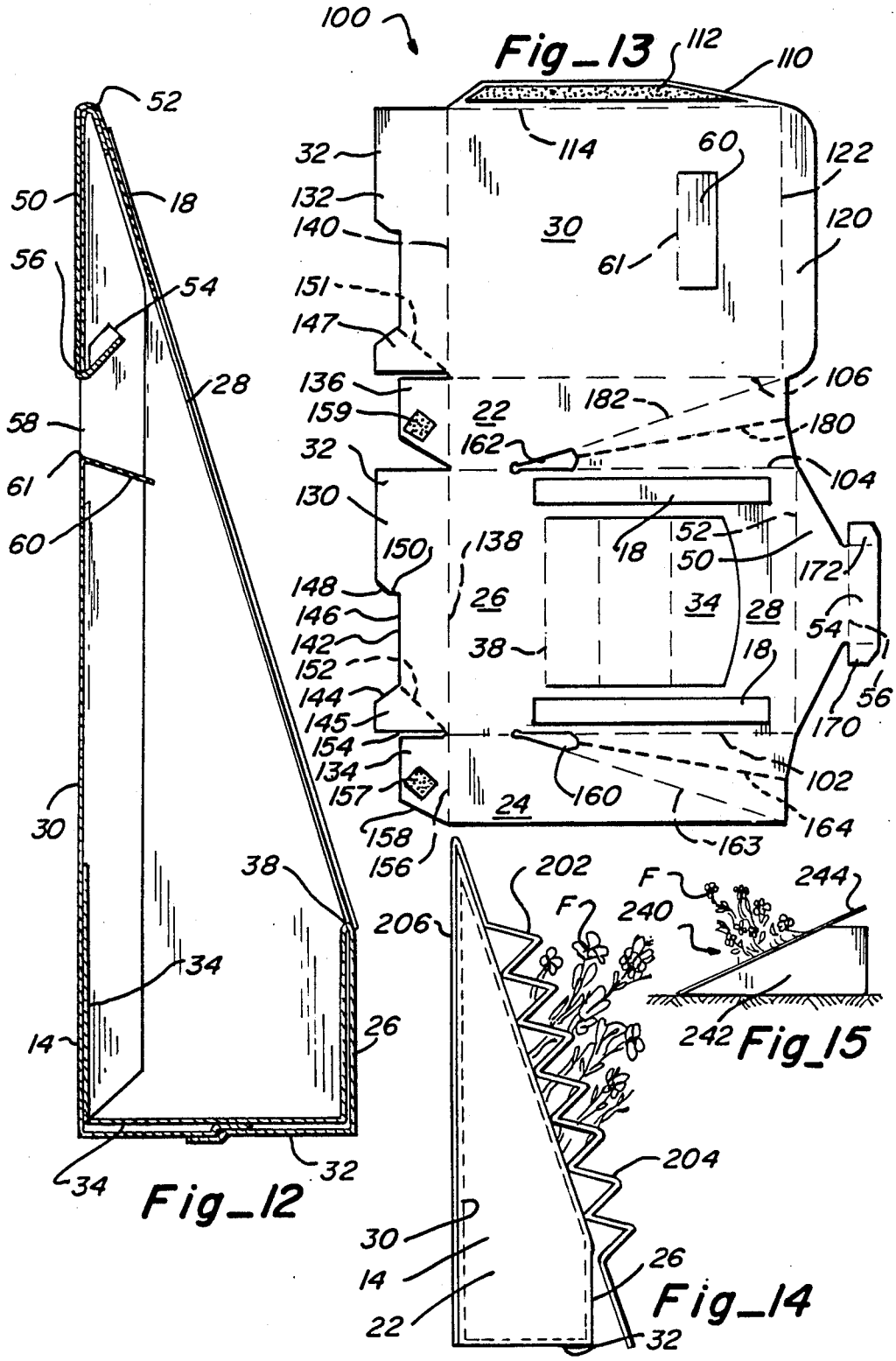
FIG. 12 shows a side sectional view of the assembled floral greeting card according to the present invention.
FIG. 13 shows a layout of the blank which forms the receptacle.
FIG. 14 shows a side view of another embodiment of the invention wherein the face card covers both the front and back of the receptacle.
FIG. 15 shows a side pictorial view of the floral greeting card according to the present invention which is positioned on its back for outdoor display.

FIG. 13 shows a layout of the blank which forms the floral greeting card 10. The entire base 14 is fabricated from the single paper board blank 100. Certain distinct features of the receptacle base 14 can be readily determined. Starting from the lower portion of the illustration is side panel 24 joined by fold line 102 to front surface or panel 26 which is connected by fold line 104 to opposite side panel 22. Side panel 22 is connected to back panel 30 by fold line 106. Extended edge tab 110 having contact adhesive 112 is joined to the inside surface of back panel 30 along fold line 114. The adhesive 112 covers most of the edge tab and contacts the back panel 30. The flap 110 has the corner nearest the bottom panel cut at approximately a 45 degree angle while the opposite end is tapered at a very slight angle to accommodate the taper of the front surface of the base. A foldable flap or seal 120 is connected to what will be the upper edge of the back panel 30 at fold line 122.

The bottom panel 32 of the base 14 forms what is called an "auto bottom" type closure. The bottom area is made up of two major flaps or tabs 130, 132 and two minor side flaps or tabs 134, 136, respectively. The bottom flaps 130, 132 are identical while the side flaps 134, 136 are also identical. For illustrative purposes, the bottom major flap 130 and side flap 134 will be described in detail. It is to be understood that this same configuration and explanation applies to the opposite flaps.

Flap 130 has a generally rectangular configuration having a width which is the same as the width of the front panel 26 and a depth which is approximately two-thirds to three-fourths of the actual depth the total bottom panel 32. This flap is adjoined to the front panel by fold line 138. The other bottom flap 132 is joined to the back surface or panel 30 by fold line 140. A notch 142 is cut from the outer edge of the flap 130. The notch 142 includes tapered end 144, straight edge 146 and opposite tapered edge 148. The inner end of tapered edge 148 is truncated by a cut line 150 which is positioned midway between the ends of the elongated flap 130 and perpendicular to edge 146. This cutout formed by the edge 150 allows the flap 130 to interleave or closely fit with flap 132. The dimension between the straight edge 146 and fold line 138 is approximately one-half of the width of the bottom surface panel 32. A fold line 152 is provided so as to extend diagonally from the intersection between the angled surface 144 and straight edge 146 and the corner of the flap 132 adjacent to the fold line 102.

A relief cutout 154 is provided between the bottom flap 130 and flap 134. The end flap 134 is also essentially rectangular and is joined to the side panel 24 by fold line 156. The width of the end flap 134 is approximately the same as the width of the side panel 24 and the length is approximately one-half of the depth of the bottom panel 32. The outer edge 158 of the flap 134 is cut diagonally back from the bottom edge of the blank to provide relief when the bottom flaps are folded together. A contact adhesive 159 is applied to the outer surface of the end flap extensions 134 to facilitate the partial assembly of the blank 100.

Along the edges of the front panel 26 and starting at a point which is about a fourth of the length of fold lines 102, 104 are positioned triangular cutouts 160, 162. A fold line 163 extends from the outer corner of the side panel 24 to the apex of the cutout triangle 160. A second fold line 164 extends also from the apex of the triangle to a point which is approximately midway along the outer surface of the side panel 24. As can be seen from the illustration, the distance between the fold line 138 and 52 of the front panel 26 is slightly greater than the distance between the fold lines 140 and 122 of the back panel 30. Thus, the outer edge of the end panel 24 tapers outwardly to the fold line 52 of the front panel 26 from the intersection of the fold line 164. This allows a smooth transition from the dimension of the back panel to the fold over flap 50. The fold over flap 50 has a foldable locking tab section 54 with outer foldable tabs 170 and 172.

Corresponding fold lines 180, 182 on side panel 22 are provided as extensions from the triangular cutout 162 much in the same way as that described for cutout 160 except that the angular arrangement is opposite to the previous description. In this way, the triangular cutout 160 in conjunction with the fold lines 163, 164 and 102 form a pleat or tuck which permits the tapering of the upper portion 28 of the front panel 26. On the opposite side of the front panel 26 is the pleat formed by the triangular cutout 162 and fold lines 104, 180 and 182. This allows a portion of both side panels 22 and 24 to be folded inwardly to allow the front portion 28 to taper towards the rear.

As previously explained, front panel 26 has a centrally arranged foldable cutout or flap 34 which folds backward at fold line 38. By the same token, the back panel 30 includes finger hold cutout 60 which is joined to the back panel and remains attached by fold line 61.

For shipping and storage purposes, the blank 100 is partially assembled into the final configuration of the base 14. To accomplish this, the side panel 24 is folded backward 90 degrees at fold line 102 with respect to the front panel 26. The flap 134 is folded under the bottom flap 130 with the adhesive area 157 securely attached to the under surface of the end 145 of the bottom flap 130. The adhesive must be outside of the fold line 152 on the end 145. Next, the side panel 22 is folded backward to a 90 degree position relative to the back portion 30 at fold line 106. Again, flap 136 is folded under the end 147 of bottom flap 132. The adhesive patch 159 is securely attached to the under surface of the end 147 and completely outside of the fold line 151.

The outer shell defining the base 14 is formed by folding the flap 112 inwardly along fold line 114 until it is approximately 90 degrees with the surface of the back panel 30. Next, the side 22 is folded to a 90 degree position along fold line 104 with respect to the front panel 26. At the same time that the sides, front and back panels are folded into a three-dimensional box-like structure, the bottom flaps 130, 132 are folded so that the portion of the flap 130 opposite the notch 150 is positioned under the end flap 136 and end 147 on the bottom flap 132. At the same time, the end of the bottom flap 132 is positioned under the corresponding side flap 134 and end 145. With these portions properly positioned, the edge flap 112 is secured to the inner surface of the outer edge of the side panel 24 whereby the outer edge of the panel 24 is aligned evenly with the fold line 114. The "auto bottom" structure is then formed by carefully depressing the bottom flaps 131, 132 inwardly at the same time that the back and front panels are moved sideways with respect to each other to allow the receptacle base 14 to be folded into a generally flat configuration.

In this way, the main portion of the floral greeting card 10 is arranged in a flat partially assembled structure which can be easily handled, shipped and stored along with any number of face cards which can be preprinted or later printed to accommodate any occasion. Naturally, the floral preservative foam block 44 is stored and shipped along with these other items.

When it is time for the floral card 10 to be assembled and used, the partially assembled blank 100 is expanded by merely moving the front panel 26 and back panel 30 sideways with respect to each other and at the same time, inwardly pushing down on the bottom flaps 130, 132. This allows these flaps to interfit with the end flaps moving downwardly and accordingly to form a rigid bottom panel 32.

The pleated side panels 22, 24 are pushed inwardly in the direction shown by arrow A so that the fold lines 164 and 180 move inwardly toward the interior of the receptacle. At the same time, the upper portion 28 of the front panel 26 folds toward the rear panel 30 to a point where the fold lines 102, 104 on the front panel are juxtapositioned adjacent to the fold lines 163, 182, respectively. The upper flap or seal 120 on the back panel 30 is then folded inward adjacent to the inside surface of the panel 30 and over the inwardly positioned side panels. Next, the front flap extension 50 is folded backwardly along fold line 52 to a point where it lies adjacent to the outer surface of the back panel 30. The cutout 60 is pushed inwardly and folded along the inside surface of the back panel. The fold line 56 is designed to correspond with the upper edge of the opening formed by the cutout 60. With the end tabs 170, 172 of the flap 54 folded inward, the locking flap 54 is pushed through and into the interior of the receptacle and folded upwardly along fold line 56 so that the tab 54 is essentially positioned along the inside surface of the back panel 30. The tabs 170, 172 are extended so that the flap 54 is essentially locked within the opening provided by the cutout 60. In this way, the receptacle base is held rigid and secured and the user can conveniently carry the completed floral card by inserting several fingers into the opening provided by cutout 60 for easy carrying of the floral card in an upright position.

The front central cutout flap 34 is folded inwardly into the receptacle base 14 along fold line 38 and is pushed downwardly along additional fold lines to position the flap 34 flush with the inside surfaces of the front panel 26, bottom panel 32 and back panel 30. As explained earlier, this provides additional rigidity and reinforcing in the bottom portion of the base 14. At this point, the floral preservative block can be carefully positioned through the opening created by the flap 34 so that it is positioned in the bottom of the receptacle and nested within the folds of the front flap 34. A face card 12 is then selected and is properly positioned and attached to the tilted or slanted portion 28 after the protective strips 40 are removed from the adhesive 18.

The floral card according to the present invention can be arranged with several different face card configurations. Besides the flat face card which has been previously shown and described, it is also possible to provide a dual cover face card 202 which can have a front portion 204 extending along the front panel 26 of the base 14 and a back portion which folds and extends along and covers the entire outer surface of the back panel 30. In this way, a decoration as well as phrases or statements can be provided on both the front and back of the face card and properly displayed and supported by the receptacle base 14. A central opening can be provided along the front portion 204 of the face card 202 with the floral arrangement positioned through the opening and supported in the preservative block 44. It is also to be understood that as an alternative, the central opening can be provided in the back surface 206 of the face card 202 and a corresponding opening can be cut or formed in the back panel 30 to allow the floral arrangement to extend either through the front portion or back portion of the face plate or both.

As another embodiment, the floral greeting card 240 according to the present invention can be provided for more rugged use such as in a cemetery. In this arrangement, the receptacle base 242 of the floral greeting card 240 can be reclined by lying on the back panel in what may be considered a backward position with the face plate 244 placed in a reversed position as shown in FIG. 15 with the bottom edge of the face card 244 adjacent to the ground or support surface. In this way, the floral arrangement can be positioned within the central opening and positioned to extend outwardly along the inclined surface of the face card 244. This type of floral card can be used in cemeteries at grave cites or can be used with floral arrangements which can spread out along the face plate as well as the support surface.

As an additional embodiment, a folded three-dimensional face card 204 as depicted in FIG. 14 can be provided which can have accordion type folds and pleats or can have outwardly extending or standing flaps providing various types of displays. It is also to be understood that the floral greeting card according to the present invention can omit the face card altogether and the design can be printed directly on the front panel of the base with the floral arrangement extending outwardly through the opening 36 provided by flap 34.

The material which is used to form the blank 100 for assembly of the base 14 can be heavy paper board, thin paper, plastic, metal or any other sheet material which will provide the strength and rigidity desired as well as the foldability for the partial assembly and expanded assembly of the finished product. This material can be coated with a plastic material by either lamination or spray application or can be coated with a clay type substance to seal the pores of the material and retard the absorption of moisture either from the interior preservative liquid for the cut flowers or plants or from the exterior environment or atmospheric moisture. The printing provided on the face cards is usually of the ultraviolet inhibited type to reduce the effect of sunlight on the display. In addition, the printing can be coated by a layer of varnish, lacquer or polyurethane to make the material water and moisture resistant and reduce atmospheric deterioration for outside use.

While a new and novel floral greeting card has been shown and described in this application, it is to be understood that this invention is not to be limited in any way by the specific illustrations which are described herein or solely to greeting cards, but is to include any variations, modifications or devices which fall within the scope of the appended claims.

What is claimed is:

1. An expandable greeting card for special occasions and for displaying a decorative arrangement, the greeting card comprising:

(a) a box-like hollow receptacle base means having front and back panels alternately joined along fold lines with two side panels, a number of bottom flaps are provided at one corresponding end of each of the panels, said bottom flaps being arranged so that the flaps fold back against the inside of the panels when the panels are folded to a first collapsed position with the back and one side panel lying adjacent to the front and other side panel, said bottom flaps folding outwardly when the panels are moved to an expanded position to form an interlocking bottom panel for the receptacle base means, said front panel having an outer edge opposite the edge adjacent the bottom flap and a central cutout opening provided therein; and (b) face card means having an aperture formed therein, said face card means being attached by suitable fastening means to the front panel of the base means so that the face card aperture and the front panel cutout opening generally correspond whereby a decorative arrangement can be inserted through the aperture and into the receptacle base means for providing a decorative presentation.

2. An expandable greeting card as defined in claim 1 wherein the face card means includes printed material on the side which faces outward from the receptacle base means so as to present a decorative appearance.

3. An expandable greeting card as defined in claim 1 wherein said face card means is of sufficient size to be folded back on itself so as to cover both the front and back panels of said receptacle base means.

4. An expandable greeting card as defined in claim 1 wherein said face card means is arranged to have a plurality of fold lines provided across said face card means so that said face card means can be folded into a three-dimensional configuration.

5. An expandable greeting card as defined in claim 1 wherein the fastening means used to attach the face card means to the receptacle base means is an adhesive means having two strips of double contact adhesive, each adhesive strip being positioned on one side of the central cutout opening in said front panel.

6. An expandable greeting card as defined in claim 1 wherein a plurality of fold lines form a pleat in each of the side panels, each of said pleats extend inwardly from an exposed edge of the panel opposite the bottom panel, said fold lines extend at least partially longitudinally along said side panels whereby the side panel can be folded so that the outer edge of the front panel can be folded toward the back panel so that at least a portion of the front panel is caused to slant toward the back panel, and an extension tab means is provided on the outer edge of said front panel which can be folded and attached to said back panel to secure the front panel in the slanted position.

7. An expandable greeting card as defined in claim 6 wherein the fold lines producing the pleats in the side panels are arranged so that the outer edge of the front panel opposite the bottom panel can be moved adjacent to the outer edge of the back panel and said extension tab means is secured to the back panel by a locking tab inserted into a suitable cutout provided in said back panel.

8. An expandable greeting card as defined in claim 1 wherein the decorative arrangement is a floral arrangement made from cut flowers.

9. An expandable greeting card as defined in claim 1 wherein a foam block means sized to fit the interior of the bottom portion of the receptacle base means is saturated in a suitable floral preservative fluid and is positioned in the receptacle base means so that the stems of cut flowers can be inserted and held in the foam block means to properly retain the floral arrangement.

10. An expandable greeting card as defined in claim 9 wherein the foam block means is wrapped and completely sealed in a thin, fluid impervious material to prevent evaporation and loss of the floral preservative fluid.

11. An expandable greeting card as defined in claim 9 wherein the interior surfaces of the front, back, bottom and side panels adjacent to said foam block are coated with a water resistant material to prevent the preservative fluid in said block from being absorbed into the panels making up said receptacle base means.

12. An expandable greeting card as defined in claim 1 wherein said panels are formed from thin paperboard sheet material.

13. An expandable greeting card comprising:

(a) two initially flat blanks, a first blank being folded and partially assembled to form a generally flat expandable receptacle base means which can be easily stored and shipped along with a second flat blank;

(b) said first expandable blank being expanded to a three-dimensional assembled condition when folded flaps are fastened and interleaved to form a closed bottom panel for said receptacle base means;

(c) said second flat blank has printed matter one one side, said second flat blank includes fastening means, said second blank being attached to the first assembled blank by means of said fastening means with the printed matter exposed to provide a pleasing presentation;

(d) the first expandable blank is comprised of a front, back, and pair of side panels that are connected alternately to each other along edge fold lines; and (e) said side panels include a plurality of fold lines which form a pleat extending longitudinally inward from an outer edge opposite the bottom panel so that the outer edge of the front panel can be folded to contact the outer edge of the back panel forming a slanting front surface, and said second flat blank is attached to said slanting front surface.

14. An expandable floral greeting card for displaying a floral arrangement, the greeting card comprising:

(a) a partially assembled receptacle base means having a front and back panel and side panels interspersed between and along each side of said front and back panels, the contiguous edges between said panels are joined by fold lines which allow the front panel and one side panel to be folded into a flat position adjacent to the back panel and other side panel, each of said panels having a suitable flap formed along one corresponding edge, said flaps being arranged to interfit and be attached to each other so that the flaps will form a bottom panel when said front, back and side panels are moved into a hollow expanded position; and (b) each of said side panels having a plurality of fold lines arranged to form a pleat with the fold lines extending inwardly from the edge of the side panels opposite from said bottom forming flaps, the pleat fold lines in said side panels being arranged to extend only a portion of the longitudinal dimension of said side panels whereby when the pleats are folded toward the interior of the receptacle base means a portion of the front panel will be folded toward the back panel to provide a slanting front portion so that an outer edge of the front panel opposite the bottom forming flaps will be adjacent to an outer edge of the back panel, a securing means is provided to hold the edges of the front and back panels in adjacent position to retain the slanting configuration of the front panel, said slanted portion of the front panel having a central cutout provided therein for displaying a floral arrangement.

15. A floral greeting card as defined in claim 14 which further includes face card means having a generally central aperture which is smaller than the base receptacle cutout, said face card means contains printed subject matter suitable for the desired occasion, said face card means with the printed side positioned away from the base means is attached by suitable adhesive means to the slanted portion of the front panel with the central aperture aligned with the cutout in said front panel, said aligned aperture and cutout providing an opening so that the stems of a floral arrangement can be inserted into the hollow interior of the receptacle base means so that a suitable floral decorative presentation can be provided.

16. A floral greeting card as defined in claim 15 wherein said face card means is sized to cover both the front and back panels of said receptacle base means and the portion of the face card means adjacent to the back panel is attached to the back panel by a suitable adhesive means with the remaining portion of the face card means being folded over the front panel and allowed to remain unattached.

17. A floral greeting card as defined in claim 16 wherein a portion of the face card means adjacent to said front panel includes an aperture provided therein which corresponds substantially with the central cutout in said front panel and said face card means includes fold lines which allow the face card means to form a three-dimensional configuration.

18. A floral greeting card as defined in claim 14 wherein a foam retainer block sized to fit the interior hollow bottom portion of said receptacle base means is positioned within the base means so that the stems of the floral arrangement can be inserted into the foam material to properly hold and support the floral arrangement.

19. A floral greeting card as defined in claim 18 wherein said foam retainer block is saturated with a floral preservative fluid and sealed in a thin transparent membrane wrapping to prevent evaporation of the fluid.

20. A floral greeting card as defined in claim 19 wherein the stems of the flower arrangement are inserted through the thin membrane wrapping so that the preservative fluid will be substantially retained within said block to help prevent evaporation.

21. A floral greeting card arrangement as defined in claim 14 wherein the interior surfaces of the front, back, bottom and side panels are coated with a resistent material.

* * * * *